US005499819A

United States Patent [19]

Nagamoto

[11] Patent Number: 5,499,819

[45] Date of Patent: Mar. 19, 1996

[54] GOLF CLUB HEAD AND A METHOD FOR PRODUCING THE SAME

[75] Inventor: Itsushi Nagamoto, Hamamatsu, Japan

[73] Assignee: Yamaha Corporation, Japan

[21] Appl. No.: 178,758

[22] Filed: Jan. 7, 1994

[30] Foreign Application Priority Data

Jan. 8, 1993 [JP] Japan ..... 5-016838

[51] Int. Cl.[6] ..... A63B 53/04

[52] U.S. Cl. ..... 273/169; 273/167 F; 273/167 H

[58] Field of Search ..... 273/167 R, 77 R, 273/167 H, 167 F, 169, 170, 171, 172, 173, 175, 194 B, 194 R, 193 R

[56] References Cited

U.S. PATENT DOCUMENTS

| | | | |
|---|---|---|---|
| 1,683,639 | 9/1928 | Vaile | 273/169 |
| 3,250,536 | 5/1966 | Moser | 273/167 F |
| 4,027,885 | 6/1977 | Rogers | 273/167 F |
| 4,355,808 | 10/1982 | Jernigan | 273/169 |
| 4,502,687 | 3/1985 | Kochevar | 273/167 H |
| 4,508,350 | 4/1985 | Duclos | 273/169 |
| 4,824,116 | 4/1989 | Nagamoto | 273/167 H |
| 4,928,972 | 5/1990 | Nakanishi | 273/167 H |
| 5,056,705 | 10/1991 | Wakita | 273/173 |
| 5,135,227 | 8/1992 | Okumoto | 273/167 H |
| 5,184,823 | 2/1993 | Desboilles | 273/167 H |
| 5,193,811 | 3/1993 | Okumoto | 273/167 F |

FOREIGN PATENT DOCUMENTS

| | | | |
|---|---|---|---|
| 4050023406 | 2/1993 | Japan | 273/167 F |
| 19688 | of 1897 | United Kingdom | 273/169 |

*Primary Examiner*—Sebastiano Passaniti
*Attorney, Agent, or Firm*—Ostrolenk, Faber, Gerb & Soffen

[57] ABSTRACT

In construction of a shell-type golf club head having a cavity and a hosel shaft hole communicating with the cavity, a mass made of solidified low melting point metal or synthetic resin containing dispersed metallic balls is provided at a selected position within the cavity through infusion via the shaft hole. Supplemental mass addition and weight distribution adjustment can be both carried out very simply without any substantial rise in cost. When located on an internal wall of the cavity contiguous to the club head face, the mass provides enlarged sweet spot on the face.

9 Claims, 3 Drawing Sheets

GOLF CLUB HEAD AND A METHOD FOR PRODUCING THE SAME

BACKGROUND OF THE INVENTION

The present invention relates to a golf club head and a method for producing the same, and more particularly relates to improvement in adjustment of supplemental mass addition and of the position of the center of gravity of a shell-type golf club head such as an iron or wood club head.

A CFRP club head having a shell made of carbon fiber reinforced plastics and a metallic club head having a shell made of Ti, Al or stainless steel are well known as examples of the above-described shell-type golf club head having cavitious main bodies.

Such a shell-type club head is, however, too light to allow good swing control and, in order to make up for such poor operability, a supplemental mass has to be added to the club head after its shaping in production. This supplemental mass addition requires highly complicated technique and much labour in order to obtain well adjusted weight distribution over the entire body of the golf club head. Stated otherwise, a significant rise in production costs is necessitated by the conventional process of supplemental mass addition.

SUMMARY OF THE INVENTION

It is thus the basic object of the present invention to simplify supplemental mass addition and weight distribution adjustment after initial shaping of a shell type golf club head.

In accordance with the first aspect of the present invention, a mass made of solidified low melting point metal is fixed at a selected position within the cavity of a cavitious main body.

In accordance with the second aspect of the present invention, a mass made of solidified synthetic resin containing metallic balls is fixed at a selected position within the cavity of a cavitious main body.

In accordance with the third aspect of the present invention, a cavitious main body with a hosel defining a shaft hole communicating with a cavity of the main body is first prepared, molten low melting point metal is infused into the cavity via the shaft hole, the low melting point metal is located at a selected position within the cavity, and the low melting point metal is solidified there.

In accordance with the fourth aspect of the present invention, a cavitious main body with a hosel defining a shaft hole communicating with a cavity of the main body is first prepared, molten synthetic resin containing metallic balls is infused into the cavity via the shaft hole, the molten synthetic resin is located at a selected position within the cavity, and the the synthetic resin is solidified there.

DESCRIPTION OF THE PREFERRED EMBODIMENT

Figure 1:
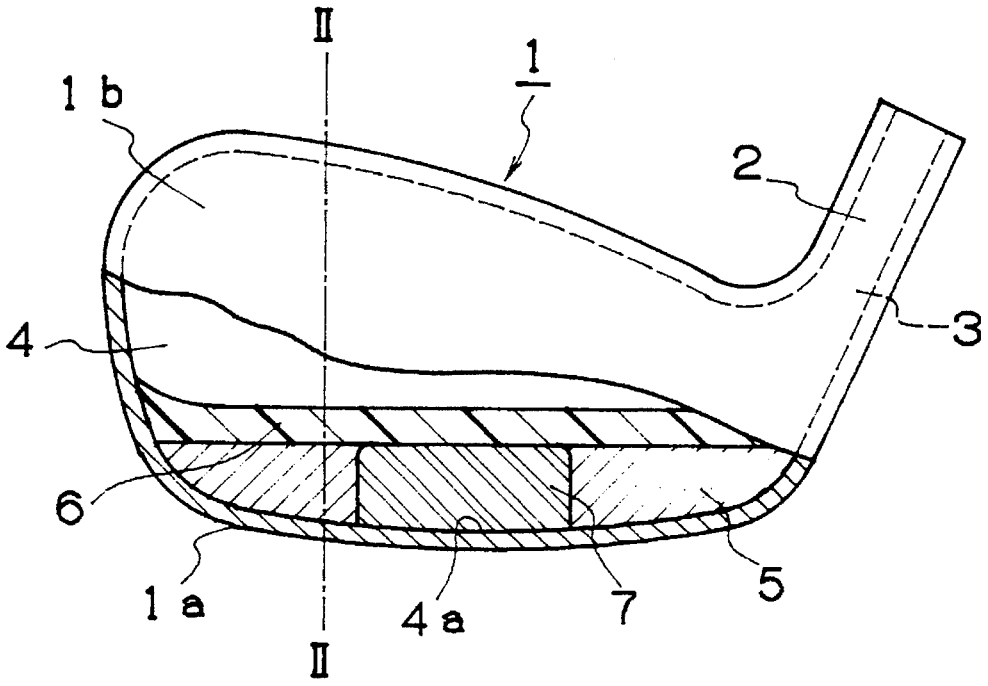
FIG. 1 is a front view, partly in section, of one embodiment of the golf club head in accordance with the present invention.
Figure 2:
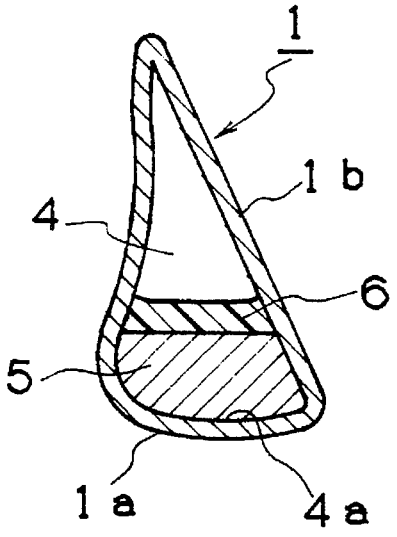
FIG. 2 is a section taken along a line II—II in FIG. 1.

One embodiment of the golf club head in accordance with the present invention is shown in FIG. 1, in which a main body 1 has a shell structure made of carbon reinforced plastics or metal and a hosel 2 is formed at one end of and in one body with the main body 1 while defining a shaft hole 3 which receives of a shaft (not shown). The shaft hole 3 in the hosel 2 communicates with a cavity 4 in the main body 1, which accommodates a mass 5 fixed on its internal bottom wall 4*a* contiguous to the sole 1*a* of the club head. The mass 5 is made of solidified low melting point metal such as Pb, Cu, Be—Cu, Zn and brass.

The mass 5 is added in order to increase the total weight of the club head. The top of the mass is covered with a synthetic resin layer 6.

A light block 7, made of Al or ceramics, is additionally fixed on the inner bottom wall 4*a* in order to adjust the weight distribution of the club head. Use of the light block 7 further enables tow-and-heel weight balance adjustment.

Figure 3:
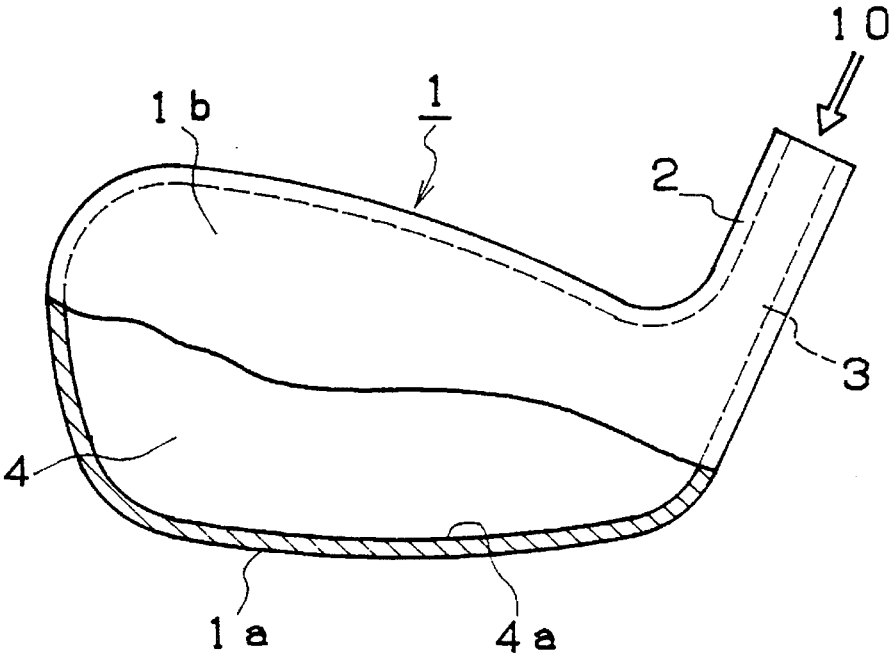
FIG. 3 is a front view, partly in section, for showing infusing of molten low melting point metal into the cavity of the main body of a golf club head.
Figure 4:
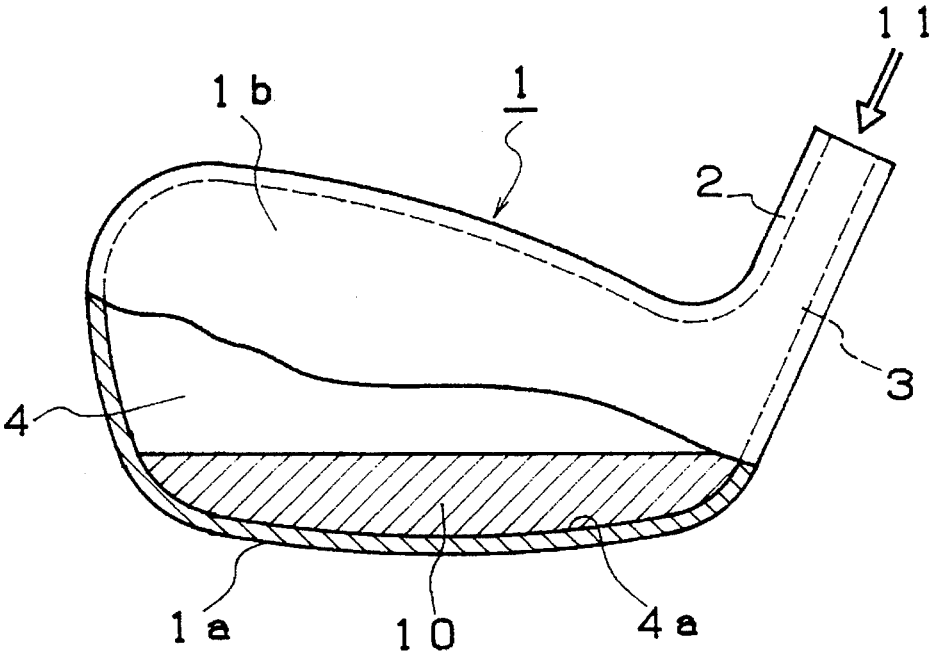
FIG. 4 is a front view, partly in section, for showing infusion of molten synthetic resin into the cavity of the main body of a golf club head.

In production, the cavitious main body 1 having the hosel 2 is first prepared and, next as shown in FIG. 3, molten low melting point metal 10 is infused into the cavity 4 of the main body 1 via the shaft hole 3 of the hosel 2. Next, the low melting point metal 10 is permitted to solidify after it has been located at a selected position on the internal bottom wall 4*a*. Finally as shown in FIG. 4, molten synthetic resin 11 is infused into the cavity 4 again via the shaft hole 3 in the hosel.

Figure 5:
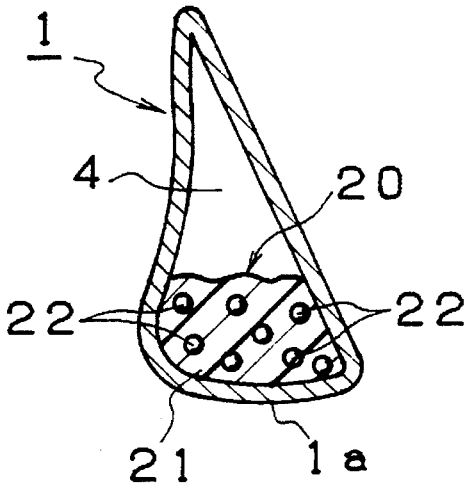
FIG. 5 is a sectional side view of another embodiment of the golf club head in accordance with the present invention.

Another embodiment of the golf club head in accordance with the present invention is shown in FIG. 5. in which a main body 1 accommodates a mass 20 made of solidified synthetic resin 21 and a number of small metallic balls 22 dispersed in the resin matrix.

In production, the cavitious main body 1 having the hosel 2 is prepared as in the case of the first embodiment and, next, molten synthetic resin is infused into the cavity 4 of the main body 1 together with metallic balls via the shaft hole 3 of the hosel 2. Next, the synthetic resin is permitted to solidify after it has been located at a selected position on the internal bottom wall contiguous to the sole 1*a* of the club head.

Figure 7:
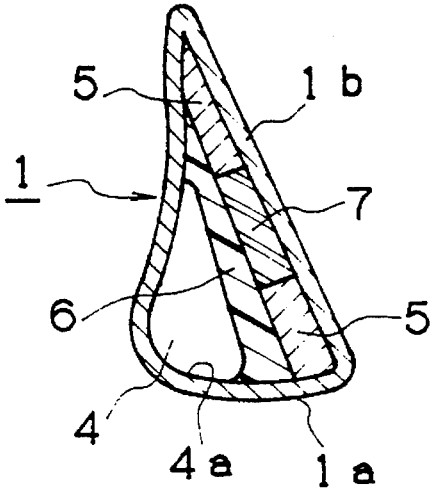
FIG. 7 is a section taken along a line VII—VII in FIG. 6.
Figure 6:
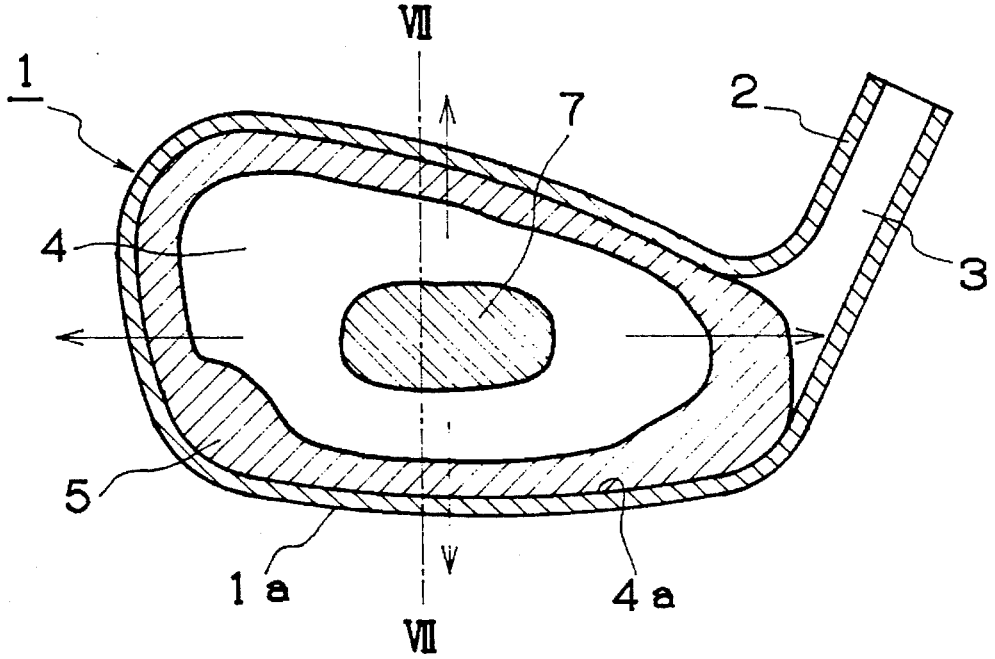
FIG. 6 is a sectional front view of the other embodiment of the golf club head in accordance with the present invention.

The other embodiment of the golf club head in accordance with the present invention is shown in FIGS. 6 and 7, in which a block 7 is located on an internal wall of the cavity 4 contiguous to the face l*b* of the club head. The block 7 is further surrounded by a mass 5. As shown with arrows in FIG. 6, such an arrangement results in a broader sweet spot on the face of the club head. In this case, the mass 5 may be made of either solidified low melting point metal or solidified synthetic resin containing dispersed metallic balls. As in the foregoing embodiment, the block 7 is made of light metal such as Al and ceramics.

To reliably fix the mass 5 within the cavity 4, one or more projections may preferably formed on the internal wall of the cavity at the spot where the mass is located. Fastener screws may be used in order to fix the mass 5 to the wall of the cavity 4.

In accordance with the present invention, use of a mass made of solidified low melting point metal well simplifies both supplemental mass addition and weight distribution adjustment. This can be achieved by use of a mass made of solidified synthetic resin containing dispersed metallic balls too. Location of a mass with a light block on the internal wall contiguous to the face enables enlargement of the sweet spot of the club head.

I claim:

1. A golf club head comprising:

a main body having a cavity encompassing substantially the entire volume of the body;

a mass made of solidified low melted point metal and fixed at a selected position within said cavity, said mass filling substantially less than the entire said cavity, and at least one block made of light metal which is substantially lighter than said low melting point metal and which is fixed at a selected position within said cavity.

2. A golf club head comprising:

a main body having a cavity;

a block made of metal and fixed on an internal wall of said cavity contiguous to a face of said club head; and a mass having an average weight per unit volume which is heavier than the average weight per unit volume of said block, said mass being fixed on said internal wall and surrounding said block.

3. A golf club head as claimed in claim 2 in which said mass is made of solidified low melting point metal.

4. A golf club head as claimed in claim 2 in which said mass is made of solidified synthetic resin containing dispersed metallic balls.

5. A method for producing a golf club head, said method comprising the steps of:

preparing a main body with a hosel defining shaft hole communicating with a cavity in said main body;

infusing molten low melting point metal into said cavity via said shaft hole in said hosel;

locating said molten low melting point metal at a selected position within said cavity; and solidifying said low melting point metal at said selected position;

locating and fixing at least one block made of a metal which is lighter than said low melting point metal at a selected position within said cavity.

6. A method as claimed in claim 5, and with said low melting point metal is chosen from a group consisting of Pb, Cu, Be—Cu, Zn and brass.

7. A method as claimed in claim 5 or 6, further comprising the step of infusing molten synthetic resin into said cavity via said shaft hole in said hosel after solidification of said low melting point metal.

8. A golf club head, comprising:

a main body having a cavity;

a block made of light metal and fixed on an internal wall of said cavity contiguous to a face of said club head; and a mass made of solidified low melting point metal, said mass being fixed on said internal wall and surrounding said block.

9. A golf club head, comprising:

a main body having a cavity;

a block made of a light metal and fixed on an internal wall of said cavity contiguous to a face of said club head; and a mass made of solidified synthetic resin containing dispersed metallic balls fixed on said internal walls surrounding said block.

* * * * *